United States Patent [19]

Yamada et al.

[11] 4,109,451

[45] Aug. 29, 1978

[54] METHOD AND DEVICE FOR REMOVING IMPURITIES FROM A SPINNING ROTOR OF AN OPEN-END SPINNING APPARATUS

[75] Inventors: Yasuo Yamada, Kariya; Kazuo Kamiya, Nishio; Iwao Katayama, Chita; Kozo Motobayashi, Nishikasugai; Yoshiaki Yonemura, Nagoya, all of Japan

[73] Assignee: Kabushiki Kaisha Toyoda Jidoshokki Seisakusho, Japan

[21] Appl. No.: 793,968

[22] Filed: May 5, 1977

[30] Foreign Application Priority Data

May 8, 1976 [JP] Japan ..... 51-51687

[51] Int. Cl.[2] ..... D01H 11/00

[52] U.S. Cl. ..... 57/56; 57/34.5; 57/58.89; 57/156

[58] Field of Search ..... 57/56, 58.89–58.95, 57/156, 34 R

[56] References Cited

U.S. PATENT DOCUMENTS

| | | | |
|---|---|---|---|
| 3,760,577 | 9/1973 | Kihara et al. | 57/56 |
| 3,810,352 | 5/1974 | Miyazaki et al. | 57/56 X |
| 3,884,027 | 5/1975 | Schumann et al. | 57/56 |

*Primary Examiner*—Donald Watkins

*Attorney, Agent, or Firm*—Burgess, Ryan and Wayne

[57] ABSTRACT

In an open-end spinning apparatus provided with a spinning rotor rotatably disposed in a rotor housing and a combing roller rotatably disposed in a frame body, a spinning chamber being formed when the frame body is combined with the rotor housing when the normal spinning operation is carried out, when it is required to remove impurities from the inside wall of the spinning rotor, firstly the frame body is displaced away from the rotor housing and simultaneously a receiving plane is created at a position adjacent to the opened rotor housing, where suction force is being applied, and secondly, the impurities are removed from the spinning rotor and accumulated on the receiving plane so that the received impurities are carried outside of the spinning apparatus by the suction force.

7 Claims, 6 Drawing Figures

METHOD AND DEVICE FOR REMOVING IMPURITIES FROM A SPINNING ROTOR OF AN OPEN-END SPINNING APPARATUS

BRIEF EXPLANATION OF THE INVENTION

The present invention relates to a method and device for removing impurities from a spinning rotor of an open-end spinning apparatus. More particularly, the present invention relates to a method and device for removing impurities from a spinning rotor of an open-end spinning apparatus by a suction means by way of a member for receiving impurities taken from the spinning rotor.

According to our experience, it is well known that, in the open-end spinning apparatus, impurities such as trash remain in a fiber collecting zone of the spinning rotor and the quantity of such remaining impurities gradually increases during the spinning operation. If the quantity of such impurities remaining in the spinning rotor exceeds a certain limitation, the yarn forming condition is gradually injured, so that the tensile strength of yarn is gradually lowered, and finally, the yarn being taken from the spinning rotor is broken. Before the above-mentioned final situation, the uniformity of thickness of yarn and the yarn appearance are also injured, and if the impurities deposited in the spinning rotor is not removed, the lowering of the yarn quality may be enhanced in accordance with the increase of the impurities deposited in the spinning rotor. To prevent the above-mentioned troubles, in the conventional open-end spinning process, it is best to remove the deposited impurities from the spinning rotor periodically or at the time of yarn breakage during the spinning operation.

In the conventional method for removing impurities from the spinning rotor, it is a normal to remove the impurities from the spinning rotor manually. That is, when the cleaning operation is required, a frame provided with a fiber-bundle supply mechanism and a mechanism for separating a bundle of fibers supplied from the supply mechanism into individual fibers, is removed from a frame which supports a spinning rotor. Then, the impurities deposited in the fiber collecting zone of the spinning rotor are removed from the spinning rotor by a cleaning action, such as a manual operation of brushing the inside wall of the spinning rotor. However, in the above-mentioned cleaning action, there is a tendency for the impurities removed from the spinning rotor to adhere to an inside wall of the frame provided with the fiber-bundle supply mechanism and the mechanism for separating the supplied bundle of fibers into individual fibers; or for the removed impurities to fly into the atmosphere outside of the open-end spinning apparatus. In the former case, when the above-mentioned frame is returned to its normal working position, the impurities adheres to the inside wall of the frame are introduced into a belt drive mechanism for rotating the spinning rotor, or are deposited in a gap between a packing secured to an engaging portion of the frame which supports the spinning rotor and an annular flange secured to the above-mentioned frame so that air leakage from the spinning rotor is created. On the other hand, in the latter case, when the above-mentioned impurities fly into the atmosphere outside of the open-end spinning apparatus, it is possible that such impurities will be caught by a winding mechanism or the other open-end spinning units disposed at a position adjacent to the spinning unit from where the above-mentioned impurities were removed, so that the yarn is possibly broken in those portions. Since the above-mentioned belt-drive mechanism is disposed in the frame in sealed condition, if such impurities are introduced into the space of the belt driving mechanism, the following problems can not be avoided.

(a) The durability of the belt is shortened, if the above-mentioned impurities adhere to on the driving surface of the belt.

(b) The belt tends to slip against its driving elements so that excessive heat is created and, consequently, there is a possibility of a fire being started.

(c) It is very difficult to clean the belt surface whereon the above-mentioned impurities are adhered and, consequently, the labor cost for cleaning such a belt are increased.

Recently, an automatic cleaning device provided with a suction pipe connected to the spinning rotor was proposed. In this device, the suction pipe is connected to a suction source so that the above-mentioned impurities deposited in the fiber collecting zone are removed from the spinning rotor by the suction air force and delivered away from the spinning rotor by way of the suction pipe. However, since the connecting position of the suction pipe with the spinning rotor is located at a position outside of the center of the spinning rotor because of the disposition of a separator disposed in the spinning rotor, it is almost impossible to remove the deposited impurities by the suction force from the spinning rotor uniformly. Moreover, the possibilities exist that the above-mentioned deposited impurities will be caught by the separator or the navel of the spinning rotor.

A purpose of the present invention is to provide a semi-automatic method for removing deposited impurities from a spinning rotor of the conventional oepn-end spinning apparatus.

Another purpose of the present invention is to provide a cleaning device utilizing a suction device for removing deposited impurities from the spinning rotor of the conventional open-end spinning apparatus.

To attain the above-mentioned purposes of the present invention, when it is required to remove impurities deposited on the fiber collecting surface of a spinning rotor, such impurities are removed by manual operation utilizing a cleaning means such as a brush, while the sealing member which cover the frame which supports the spinning rotor are open. However, to prevent any possible scattering of the removed impurities, a receiving member, such as a plate-like member, is disposed at a position below the spinning rotor. The receiving member is provided with an aperture where a suction conduit is connected to the receiving member. This suction conduit is also connected to a suction force. Therefore, the above-mentioned removed impurities deposited on the receiving member are sucked into the suction conduit, so that these impurities can be semi-automatically collected at a desired position outside of the open-end spinning apparatus by the action of the suction source. To prevent any disturbance of the spinning operation by the above-mentioned receiving member, the receiving member is disposed to the machine frame in such a condition that the receiving member is only displaced to a receiving position from its standby position, where disturbance of the normal spinning operation can be avoided, when the above-mentioned sealing member is opened. It is further practical to utilize an on-off valve in the suction conduit which is opened at a time when the above-mentioned sealing member is opened, so that the suction force is only applied to the suction conduit at the time of cleaning the spinning rotor. As mentioned above, the cleaning operation of the spinning rotor can be effectively carried out without increasing the labor cost. Therefore, the method and apparatus for removing impurities from the spinning rotor according to the present invention remarkably contribute the usefulness of the open-end spinning system.

DETAILED EXPLANATION OF THE INVENTION

Figure 1:
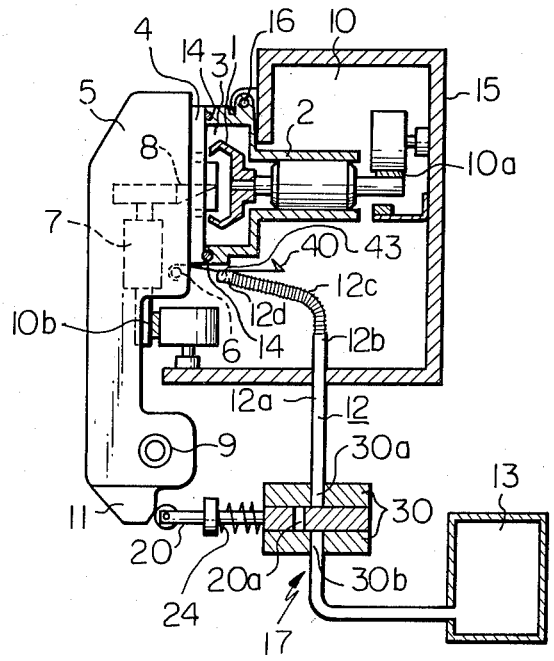
FIG. 1 is a schematic side view of a conventional open-end spinning apparatus utilizing the device for removing deposited impurities from the spinning rotor according to the present invention.
Figure 2:
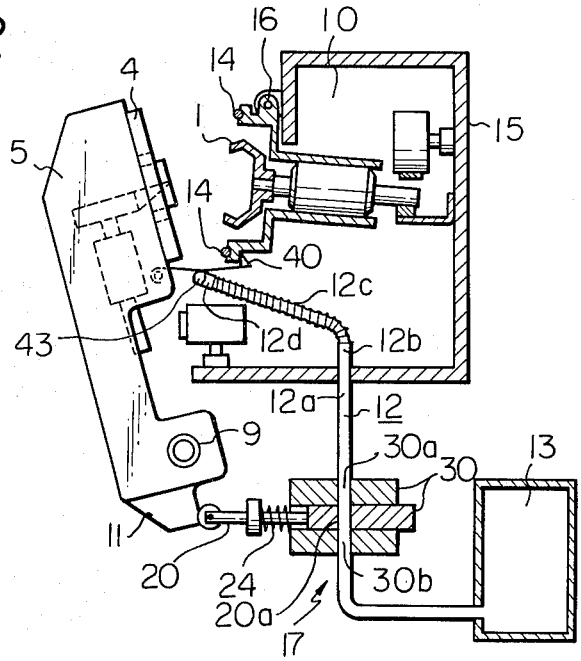
FIG. 2 is a schematic side view of the open-end spinning apparatus shown in FIG. 1 in a condition of carrying out the cleaning operation according to the present invention.

Since a method and device for removing impurities deposited in the spinning rotor of an open-end spinning apparatus according to the present invention can be adopted to the conventional open-end spinning apparatus, a preferable embodiment applied to such an open-end spinning apparatus, wherein a spinning rotor is disposed in a rotor housing and a combing roller is disposed in a frame body which is pivotably mounted on a machine frame, is hereinafter explained in detail with reference to FIGS. 1 and 2. In FIGS. 1 and 2, a rotor housing 2, wherein a spinning rotor 1 is disposed, is turnably mounted on a pin shaft 16 secured to an upper portion of a frame 15 of a spinning unit. A pin shaft 9 is rigidly mounted on a machine frame (not shown) and a frame body 5 is turnably mounted on the pin shaft 9. A fiber supply mechanism provided with a combing roller 7 is disposed in the frame body 5 and the frame body 5 is provided with an annular flange 4 at a position facing a packing 14 disposed at an open portion of the rotor housing 2. Therefore, when the frame body 5 is turned toward the rotor housing 2 and contacts it, a spinning chamber 3 is created in a space formed by the above-mentioned contact of the frame body 5 with the rotor housing 2. The spinning rotor 1 is driven at a very high rotational speed by an endless belt 10*a* in a chamber 10 of the frame 15 which is maintained in an almost air-tight condition. The combing roller 7 is also driven at a very high rotational speed by an endless belt 10*b* in the frame body 5. Individual fibers separated from a supplied bundle of fibers by the combing roller are introduced into the spinning rotor 1 by way of a channel 8 formed in the frame body 5 and deposited on a fiber collecting wall formed in the spinning rotor 1. Such collected fibers are taken from the fiber collecting wall of the spinning rotor 1 toward the rotation axis of the spinning rotor 1, while the rotor 1 is rotated about its longitudinal axis. As a result, a twisted yarn is formed. The yarn is, then, taken up from the spinning rotor 1 and a yarn package is formed by a winding mechanism.

A supporting pin 6 is disposed to a middle portion of the frame body 5 as shown in FIG. 1. An impurity receiving plate 40 is turnably mounted on the supporting pin 6 and the pin 6 receives a resilient force from a resilient member, such as a spring (not shown), so that the plate 40 is always urged to turn in the counterclockwise direction in FIG. 1. The detailed construction of the impurity receiving plate 40 is shown in FIGS. 3 and 4.

Figure 3:
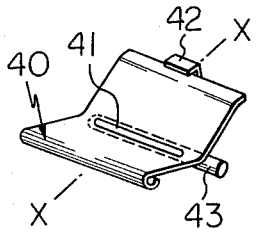
FIG. 3 is a perspective view of a receiving plate utilized for the cleaning device shown in FIGS. 1 and 2.
Figure 4:
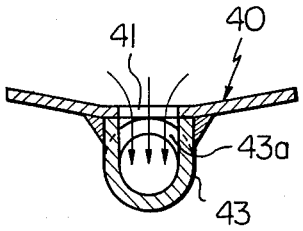
FIG. 4 is a cross-sectional view of the receiving plate, taken along a line IV—IV in FIG. 3.
Figure 6:
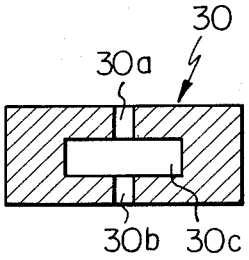
FIG. 6 is a cross-sectional view of the on-off valve taken a line VI—VI in FIG. 5.
Figure 5:
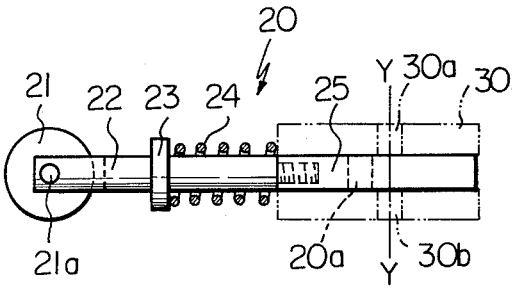
FIG. 5 is a schematic side view of an on-off valve and its related mechanism utilized for the cleaning device shown in FIGS. 1 and 2.

As shown in FIGS. 3 and 4, the impurity receiving plate 40 is provided with a slit 41, formed at a middle portion thereof along a lateral direction thereof. A suction conduit 43 is secured to a backside of the receiving plate 40, at the position corresponding to the suction aperture 41, in such a condition that a longitudinal slit 43a thereof is connected to the slit 41. One end of the suction conduit 43 is closed, while the other end of the suction conduit 43 is connected to a suction source.

Referring to FIGS. 1 through 4, the suction conduit 43 is connected, by way of a connecting conduit 12, to a suction duct 13 provided with a impurity collection device (not shown), disposed at a part of the open-end spinning frame. The receiving plate 40 is provided with an engaging hook 42 (FIG. 3) secured at an end of the plate 40 which is formed at a position facing the rotor housing 2, so that when the frame body 5 is turned about the shaft 9 so as to open the rotor housing 2, the engaging hook 42 is engaged with a part of the rotor housing 2. As a result, the frame body 5 is held at a predetermined turned position about the shaft 9, where the receiving plate 40 is held at a preferable position to receive impurities dropped from the spinning rotor 1.

According to the above-mentioned turning motion of the frame body 5, the disposition of the sunction conduit 43 is changed from its standby position shown in FIG. 1 to its working position shown in FIG. 2. To allow such a displacing motion of the suction conduit 43 in a substantially free condition, the connecting conduit 12 comprises a vertically disposed stem portion 12*a*, a portion 12*d* connected to the suction conduit 43, and a portion 12*c*, such as a bellows, which is capable of extension connecting the portion 12*d* and a tip portion 12*b* of the stem portion 12*a*.

Referring to FIGS. 1, 2, 5 and 6, the frame body 5 is provided with a cam body 11 formed at a bottom portion thereof. An on-off valve mechanism 17 is disposed at a position facing the cam body 11. The on-off valve mechanism 17 comprises a spool valve body 20 and a chamber body 30. The chamber body 30 is provided with a central space 30*c* laterally formed therein and a pair of apertures 30*a*, 30*b* formed therein at facing positions to each other, in such a condition that these apertures 30*a*, 30*b* are aligned along a common axis Y—Y which is perpendicular to the longitudinal axis of the central space 30*c*. The spool valve body 20 comprises a stem body 22 provided with a laterally expanded portion 23, a pin shaft 21*a* secured to a free end portion thereof, a cam follower 21 rotatably mounted on the pin shaft 21*a*, an on-off valve body 25 secured to the other end portion of the stem body 22 and a helical spring 24 mounted on the stem body 22 at a position between the portion 23 and the chamber body 30. Since the on-off valve body 25 is secured to the stem body 22 in an axially aligned condition and is inserted into the central space 30c in a slidable condition, the helical spring 24 always urges the on-off valve body 25 to move in a direction which would cause it to escape from the central space 30c fo the chamber body 30. The on-off valve body 25 is provided with an aperture 20a formed therein in such a condition that the aperture 20a vertically passes therethrough. Therefore, when the aperture 20a is aligned with the apertures 30a, 30b, a unit conduit is formed. The cam surface of the cam body 11 is always in contact with the cam follower 21 in such a condition that, when the frame body 5 is held in the normal spinning condition shown in FIG. 1, the on-off valve body 25 is positioned at a normal spinning condition where the aperture 20a does not meet the apertures 30a, 30b; while, when the frame body 5 is held positioned in its turned condition shown in FIG. 2, the on-off valve body 25 is positioned at a cleaning position where the aperture 20a meets the apertures 30a and 30b. In the above-mentioned construction of the on-off valve mechanism, the bottom end of the stem portion 12a of the conduit 12 is connected to the aperture 30a, while the suction duct 13 is connected to the aperture 30b.

The operation of the impurity removing device mentioned above is hereinafter explained in detail.

(1) During the normal spinning operation, the frame body 5 is urged against rotor housing 2 by means of an urging means (not shown), and such condition is stably held by a suitable fastening means (not shown), so that the spinning chamber 3 is formed. In this condition, the cam follower 21 is displaced to a position farthest from the chamber body 30 of the on-off valve mechanism 17 and the aperture 20a is not aligned with the apertures 30a and 30b. Therefore, the suction duct 13 is disconnected from the suction conduit 12 and the impurity receiving plate 40 does not receive any suction force by way of the slit 41.

(2) When it is required to remove impurities from the spinning rotor 1, the frame body 5 is turned about the pin shaft 9 in the counter clockwise direction (in FIG. 1, 2) and held in its turned condition by the hook 42 (FIG. 3) engaging with a part of the rotor housing 2. As the frame body 5 is turned about the pin shaft 9 to its turned condition, the cam body 11 urges the follower 21 toward the chamber body 30 of the on-off valve mechanism 17. In the turned condition of the frame body 5, the position of the on-off valve body 25 in the central space 30c of the chamber body 30 is changed to a condition wherein the aperture 20a is aligned with the apertures 30a and 30b. Therefore, the suction conduit 12 is connected to the suction duct 13. On the other hand, the impurity receiving plate 40 occupies a bottom space formed between the frame body 5 and the rotor housing 2. In this condition, the suction force created by a suction source (not shown) is transmitted to the slit 41 of the receiving plate 40 so that an air stream directed into the slit 41 is formed on the receiving plate 40.

(3) After the above-mentioned preparation, the impurities deposited in the spinning rotor 1 are taken therefrom by such action as manual brushing and, therefore, the impurities removed from the spinning rotor 1 are carried into the slit 41 by the above-mentioned air stream directed into the slit 41. Then the impurities are carried to a dust accumulation device (not shown) by way of the suction conduit 12, the on-off valve mechanism 17 and the suction duct 13.

(4) After completion of the above-mentioned cleaning operation, the frame body 5 is turned about the pin shaft 9 toward the rotor housing 2 and held at the normal position for carrying out the normal spinning operation.

In the above-mentioned embodiment, the spinning rotor 1 is horizontally held in a rotatable condition, however, the present invention can be successfully applied to the conventional open-end spinning apparatus wherein the spinning rotor is vertically held in a rotatable condition.

As mentioned above, in the present invention, the cleaning operation of the spinning rotor is carried out by a combination of manual and mechanical operation, whereby the cleaning operation can be carried out perfectly without any of the troubles which have been experienced in the known cleaning devices applied to the open-end spinning apparatus.

What is claimed is:

1. A method for removing impurities from a spinning rotor of an open-end spinning apparatus provided with a rotor housing wherein said spinning rotor is rotatably disposed, a frame body for forming a spinning chamber by combining with said rotor housing and a combing roller rotatably disposed in said frame body, said frame body being turnably mounted on a pin shaft which is rigidly mounted on a machine frame, comprising, when it is required to remove said impurities from said spinning rotor, firstly turning said frame body about the pin shaft to open said rotor housing and simultaneously forming an impurity receiving plane at a predetermined position adjacent to an opening of said rotor housing created by said turning of said frame body, and creating a suction air stream toward said receiving plane by said turning of said frame body, and secondly, removing said impurities from said spinning rotor, by such action as manual brushing, and accumulating then on said receiving plane by means of said suction air stream, whereby said removed impurities are carried to the outside of said open-end spinning apparatus from said receiving plane by the suction action of said suction air stream.

2. A method for removing impurities from a spinning rotor according to claim 1, wherein said receiving plan is formed at a position adjacent to a bottom portion of said opening by said turning of said frame body, so that said removed impurities are firstly dropped on said receiving plane.

3. In an open-end spinning apparatus provided with a spinning rotor and a rotor housing wherein said spinning rotor is rotatably disposed in said rotor housing, a frame body for forming a spinning chamber together with said rotor housing, a combing roller rotatably disposed in said frame body, and a machine frame whereon said frame body is displaceably mounted, a device for removing impurities from said spinning rotor comprising a receiving plate supported by a part of said frame body at a position where, when said frame body is displaced from said rotor housing so that an opening of said rotor housing is created, a part of a space formed at a position ajdacent to said opening can be occupied by said receiving plate, said receiving plate provided with a slit, a suction conduit being connected to said slit of said receiving plate, a suction source connected to said suction conduit, a mechanism for selectively connecting or disconnecting the connection between said suction conduit and said suction source in relation to the motion of changing the disposition of said frame body, whereby, when said frame body is displaced from the engaged position with said rotor housing to a position for cleaning said spinning rotor, said suction conduit is connected to said suction source, while said suction conduit is disconnected from said suction source during a period when said frame body is engaged with said spinning rotor.

4. A device for removing impurities from a spinning rotor of an open-end spinning apparatus according to claim 1, wherein said frame body is turnably mounted on a part of said machine frame so that said opening of said rotor housing can be created by turning said frame body to said position for cleaning, said receiving plate is disposed to a part of said frame body at a position where, when said opening is formed, a bottom of said space formed between said frame body and said rotor housing can be occupied by said receiving plate.

5. A device for removing impurities from a spinning rotor of an open-end spinning apparatus according to claim 4, wherein said receiving plate is provided with an engaging hook for restricting said turning of said frame body, said engaging hook is capable of engaging with a part of said rotor housing so that the turned position of said frame body and a position of said plate can be stably held at predetermined positions, respectively.

6. A device for removing impurities from a spinning rotor of an open-end spinning apparatus according to claim 4, wherein said selectively connecting and disconnecting mechanism comprises a cam surface formed at a part of said frame body, and an on-off valve mechanism for selectively connecting said suction conduit to said suction source or disconnecting said suction conduit from said suction source, a member for actuating said on-off valve mechanism, said actuation member provided with a cam follower always in contact with said cam surface, said cam surface provided with such a profile that, when said frame body is engaged with said rotor housing, said actuation member holds said on-off valve mechanism in a closed condition so that said suction conduit is closed from said suction source, while, when said frame body is turned to said position to form said opening of said spinning rotor, said actuation member holds said on-off valve mechanism in an opened condition so that said suction conduit is connected to said suction source.

7. In an open-end spinning apparatus provided with a spinning rotor and a rotor housing wherein said spinning rotor is rotatably disposed in said rotor housing, a frame body for forming a spinning chamber together with said rotor housing, a combing roller rotatably disposed in said frame body, and a machine frame whereon said frame body is displaceably mounted, a device for removing impurities from said spinning rotor comprising a receiving means supported by a part of said frame body at a position where, when said frame body is displaced from said rotor housing so that an opening of said rotor housing is created, a part of a space formed at a position adjacent to said opening can be occupied by said receiving means, a suction conduit connected to a suction source connected to said receiving means so that said impurities can be removed from said receiving means through said suction conduit, a mechanism for selectively connecting or disconnecting the connection between said suction conduit and said suction source in relation to the motion of changing the disposition of said frame body, whereby, when said frame body is displaced from the engaged position with said rotor housing to a position for cleaning said spinning rotor, said suction conduit is connected to said suction source, while said suction conduit is disconnected from said suction source during a period when said frame body is engaged with said spinning rotor.

* * * * *

UNITED STATES PATENT OFFICE

CERTIFICATE OF CORRECTION

Patent No. 4,109,451 Dated August 29, 1978

Inventor(s) Yasuo Yamada, et al

It is certified that error appears in the above-identified patent and that said Letters Patent are hereby corrected as shown below:

Column 4, line 38: "sunction" should be --suction--.

Column 7, line 6: "1" should be --7--.

Signed and Sealed this

*Twenty-ninth* Day of *May 1979*

[SEAL]

*Attest:*

RUTH C. MASON
*Attesting Officer*

DONALD W. BANNER
*Commissioner of Patents and Trademarks*